United States Patent [19]

Meller

[11] Patent Number: 4,711,047

[45] Date of Patent: Dec. 8, 1987

[54] SIGNAL FLARE CARTRIDGE

[75] Inventor: Yehuda Meller, Holon, Israel

[73] Assignee: The State of Israel, Ministry of Defence, Israel Military Industries, Israel

[21] Appl. No.: 761,798

[22] Filed: Aug. 2, 1985

[30] Foreign Application Priority Data

Jan. 24, 1985 [IL] Israel ..... 74148

[51] Int. Cl.[4] ..... F42B 4/26

[52] U.S. Cl. ..... 42/1.15; 102/484; 102/342

[58] Field of Search ..... 42/1 Z, 1 F, 1 N; 102/484, 483, 336, 342

[56] References Cited

U.S. PATENT DOCUMENTS

| | | | |
|---|---|---|---|
| 1,277,669 | 9/1918 | Viven et al. | 102/483 |
| 1,416,545 | 5/1922 | Brondby | 102/484 |
| 3,455,047 | 7/1969 | Hoag | 42/1 N |
| 3,593,451 | 7/1971 | McDonnell | 42/1 N |

FOREIGN PATENT DOCUMENTS

| | | | |
|---|---|---|---|
| 309207 | 12/1917 | Fed. Rep. of Germany | 102/483 |
| 317654 | 12/1919 | Fed. Rep. of Germany | 102/483 |
| 467762 | 12/1951 | Italy | 102/483 |
| 479987 | 2/1938 | United Kingdom | 102/483 |

*Primary Examiner*—Deborah L. Kyle
*Assistant Examiner*—Michael J. Carone
*Attorney, Agent, or Firm*—Steinberg & Raskin

[57] ABSTRACT

A signal flare cartridge for launching by firearms. The cartridge is adapted for ignition and launching by live ammunition and comprises a launcher tube holding a tubular flare body adapted to permit the passage of a bullet. Upon firing the bullet passes through the bores of the flare body and the propellant gases ignite the flare body which is propelled from the launcher tube.

9 Claims, 1 Drawing Figure

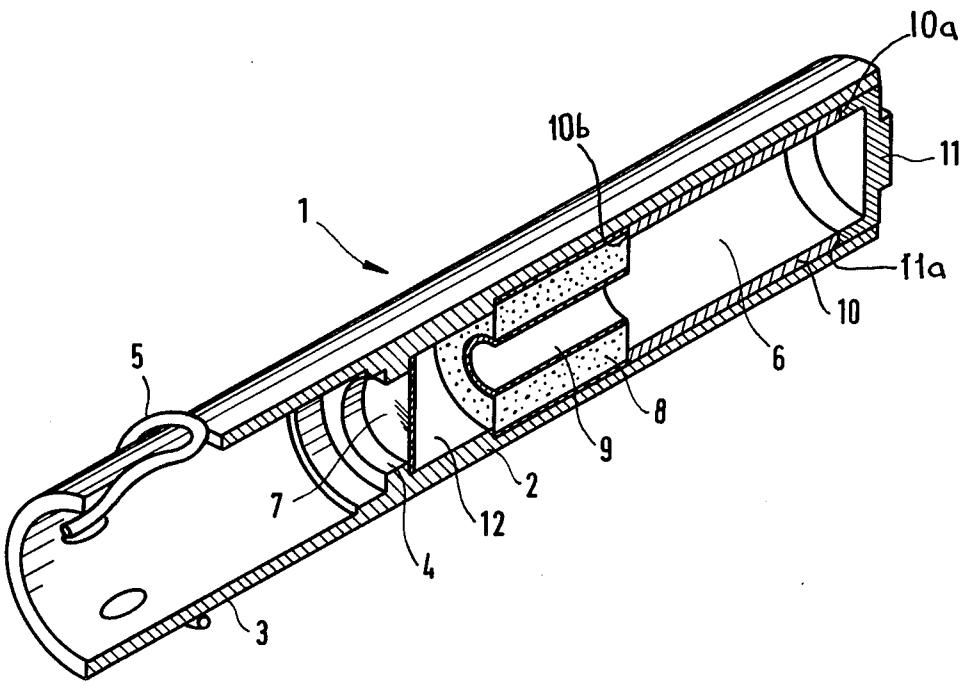
10a
11
11a
10
6
8
9
10b
2
12
4
1
7
3
5

SIGNAL FLARE CARTRIDGE

BACKGROUND OF THE INVENTION

The present invention concerns a signal flare cartridge.

Signal flares are required by combatants for various purposes which may be defined generally as identification and transmission of information. For example, a pilot who has to bail out of his plane and to land behind enemy lines may need a flare signal to identify himself to a search party; or various infantry units deployed at different spots of a terrain may use flare signals, possibly in various colours, for communication; etc.

Conventionally flare signals are produced with the aid of special firearms, e.g. a flare pistol using a special signal flare cartridge. The need for a special firearm for the production of a flare signal is an obvious disadvantage since it requires that the combatant should carry with him in addition to his assault or defence weapons, also a flare pistol.

There are also known manual flare signal launchers which are fired by striking the launcher base against a solid object such as a rock. Such launchers are however both unsafe and unreliable: unsafe because the operator may be hit by the launched, signal producing flare body;and unreliable because the necessary solid object on which the launcher has to be struck may not be available, e.g. where the operator is positioned in water or on a sand dune.

SUMMARY OF THE INVENTION

It is the object of the present invention to provide a new type of signal flare cartridge which overcomes all these drawbacks.

The present invention is based on a new concept according to which live ammunition fired from conventional firearms is used for launching a device that produces a flare signal.

In accordance with the invention there is provided a cartridge for producing a flare signal, comprising a launcher tube adapted for mounting on the barrel of a conventional firearm such that the inner tubular spaces of said barrel and launcher tube are in alignment, and a tubular flare body inside the launcher tube adapted to enable the unobstructed passage of a bullet from an ammunition round fired by said firearm and to be ignited and ejected by the propellent gases from said fired ammunition.

Thus in accordance with the present invention it is possible to use any conventional firearm such as an assault rifle, a pistol, a submachine gun etc. for producing a flare signal, which is an obvious advantage over the prior art.

DESCRIPTION OF THE DRAWINGS

The invention is illustrated, by way of example only, in the accompanying drawing which is perspective view in section of a signal flare cartridge according to the invention.

DETAILED DESCRIPTION OF A PREFERRED EMBODIMENT

The cartridge 1 according to the invention here illustrated is adapted for use with an assault rifle which is, as a rule, fitted with a flash suppressor. The cartridge comprises a body 2 having a rear portion 3 designed as an adaptor for mounting on a flash suppressor of an assault rifle. Inside body 2 there is further provided a neck portion 4 of reduced diameter serving as a stop for the front end of the flash suppressor mounted on the rifle barrel. Adaptor portion 3 is fitted with a resilient member 5 which serves as a grip and, in the mounted position, bears with a spring force on the flash suppressor to ensure that the cartridge is mounted on the rifle with a tight grip.

The functional part of the cartridge which is located in the front section 6 of body 2, is sealed off from the rear, adaptor portin 3,4 by a partition 7 which is so designed as to be readily penetrable by a bullet practically without any resistance and which serves to protect flare body 8 located inside front section 6 as described below.

Inside front section 6 within a circumferential recess thereof there is mounted a flare body 8 having an axial bore 9 designed for the unobstructed passage of a bullet therethrough. The front part of section 6 encloses a cylindrical bushing 10 whose forward end is closed by a cup-shaped sealing member 11 having on its outside a bulging portion serving for nighttime identification.

As seen in the figure, the bushing comprises a cylindrical member extending axially within said tubular body 2 from a front end **10*a* recessed inwardly from the front end of body 2 to a rear end 10*b* at the forward end of the flare body 8. The rim 11*a* of the sealing member 11 engages the front end 10*a* of the bushing 10. Between the rear end of flare body 8 and the partition 7 there is formed a chamber 12 which in operation serves a pressure chamber. As seen in the figure, the ignitable material of the flare body 8 directly communicates with the pressure chamber 12**.

In operation, the cartridge 1 shown in FIG. 1 is mounted on an assault rifle in such a way that the adaptor portion 3 tightly grips the flash suppressor of the rifle. When a live ammunition round is fired from the assault rifle with the cartridge 1 mounted on it, the fired bullet penetrates partition 7, passes through the axial bore 9 of the flare body and penetrates the cup-shaped sealing member 11, any resistance offered by partition 7 and sealing member 11 being minimal. The expansion of the propellent gases developed during the firing of the live ammunition is obstructed by the flare body whereupon pressure builds up in pressure chamber 12 whereby the flare body 8 is ignited and ejected from body 2 which thereby functions as a launcher tube, together with bushing 10 and a desired flare signal is produced.

I claim:

1. A cartridge unit for producing a flare signal, comprising a launcher tube constituted by a tubular body, means for tightly mounting one end of said tubular body on a barrel of a firearm such that the inner tubular spaces of said barrel and launcher tube are in alignment, a tubular flare body situated entirely within said launcher tube, and means for normally fixing said flare body within said launcher tube, said means including a circumferential annular shoulder formed in an inner surface of said launcher tube and a cylindrical bushing extending axially within said launcher tube having a rear end, said flare body being situated between said shoulder and said rear end of said bushing, said flare body being adapted to enable the unobstructed passage of a bullet from an ammunition round fired by said firearm and to be directly ignited and ejected from said launcher tube by the propellent gases from said fired ammunition.

2. A cartridge according to claim 1 wherein said mounting means comprise means for mounting said one end of said tubular body on a firearm fitted with a flash suppressor.

3. The combination of claim 1 wherein said flare body comprises ignitable material, and wherein said ignitable material of said flare body is in direct communication with said inner tubular space of said launcher tube rearwardly of said flare body, whereby propellent gases produced by firing said firearm directly ignites said flare body.

4. A cartridge unit for producing a flare signal, comprising:

a tubular body having rearward and forward portions and an internal surface;

means for mounting said rearward portion of said tubular body on a barrel of a firearm with a tight grip;

a flare body of substantially tubular configuration situated entirely within said tubular body and normally fixed held therewithin, said flare body mounted wtihin a circumferential internal recess formed in said forward portion of said tubular body defined by an annular shoulder formed in an inner surface of said launcher tube and a rear end of a cylindrical bushing extending axially within said launcher tube, said flare body being adapted to be ejected from a forward end of said tubular body by propellent gases produced by firing said firearm, said flare body having a substantially cylindrical bore formed therethrough having a diameter sufficient to enable the unobstructered passage therethrough of a bullet from an ammunition round fired by the firearm;

a pressure chamber defined within said tubular body rearwardly of said flare body into which propellent gases produced from firing said firearm expand; and said flare body comprising ignitable material which is in direct communication with said pressure chamber, whereby said flare body is adapted to be ignited by propellent gases produced by firing said firearm.

5. The combination of claim 4 wherein a partition is situated within said tubular body separating said rearward and forward portions thereof, and wherein said pressure chamber is defined by a space between a rearward end of said flare body and said partition.

6. The combination of claim 4 wherein said bushing extends axially within said tubular body from a front end thereof at a forward end region of said tubular body to a rear end thereof at a forward end of said flare body.

7. The combination of claim 4 wherein said front end of said bushing is recessed inwardly of said forward end of said tubular body and further including a cup-shaped sealing member for sealing said front end of said bushing, said cup-shaped sealing member having a rim engaging said front end of said bushing at a location recessed inwardly of said forward end of said tubular body.

8. A cartridge unit for producing a flare signal, comprising:

a tubular body having rearward and forward portions and an internal surface;

a partition situated within said tubular body separating said rearward and forward portions thereof;

means for mounting said rearward portion of said tubular body on a barrel of a firearm with a tight grip;

a flare body situated entirely within said tubular body in said forward portion thereof and normally fixedly held therewithin, said flare body being adapted to be ejected from a forward end of said tubular body by propellent gases produced by firing said firearm, said flare body having a substantially cylindrical bore formed therethrough having a diameter sufficient to enable the unobstructed passage therethrough of a bullet from an ammunition round fired by the firearm;

a pressure chamber defined by a space between a rearward end of said flare body and said partition into which propellent gases produced from firing said firearm expand; and said flare body comprising ignitable material which is in direct communication with said pressure chamber, whereby said flare body is adapted to be ignited by propellent gases produced by firing said firearm.

9. A cartridge unit for producing a flare signal, comprising:

a tubular body having rearward and forward portions and an internal surface;

means for mounting said rearward portion of said tubular body on a barrel of a firearm with a tight grip;

a flare body situated entirely within said tubular body and normally fixedly held therewithin, said flare body being adapted to be ejected from a forward end of said tubular body by propellent gases produced by firing said firearm, said flare body having a substantially cylindrical bore formed therethrough having a diameter sufficient to enable the unobstructed passage therethrough of a bullet from an ammunition round fired by the firearm;

a bushing comprising a cylindrical member extending axially within said tubular body from a front end thereof at a forward end region of said tubular body to a rear end thereof at a forward end of said flare body;

a pressure chamber defined within said tubular body rearwardly of said flare body into which propellent gases produced from firing said firearm expand; and said flare body comprising ignitable material which is in direct communication with said pressure chamber, whereby said flare body is adapted to be ignited by propellent gases produced by firing said firearm.

* * * * *